US005937492A

United States Patent [19]

Bozzo

[11] Patent Number: 5,937,492

[45] Date of Patent: Aug. 17, 1999

[54] FINISHING MACHINE WITH PNEUMATIC ENTRAINMENT OF FABRIC IN STRAND FORM

[75] Inventor: Giovanni Bozzo, Quaregna, Italy

[73] Assignee: Flainox, S.r.l., Biella, Italy

[21] Appl. No.: 09/008,430

[22] Filed: Jan. 16, 1998

[30] Foreign Application Priority Data

May 9, 1997 [IT] Italy ..... TO97A0395

[51] Int. Cl.[6] ..... D06C 17/00

[52] U.S. Cl. ..... 26/21; 28/167; 28/142

[58] Field of Search ..... 26/19, 20, 21; 68/5 C, 5 D, 178, 177, 20; 28/167, 142

[56] References Cited

U.S. PATENT DOCUMENTS

| | | | |
|---|---|---|---|
| 101,819 | 6/1870 | Bates | 26/21 |
| 537,170 | 4/1895 | Preston | 26/21 |
| 3,471,908 | 10/1969 | Selvas | 26/21 |
| 3,780,544 | 12/1973 | Turner et al. | 68/177 |
| 4,419,871 | 12/1983 | Zonco et al. | 26/21 |
| 5,243,840 | 9/1993 | Grafen et al. | 68/178 |
| 5,299,339 | 4/1994 | Georgantas | 68/177 |
| 5,311,627 | 5/1994 | Koch et al. | 68/178 |
| 5,621,937 | 4/1997 | Georgantas | 68/178 |
| 5,746,072 | 5/1998 | Bohnke | 68/178 |

FOREIGN PATENT DOCUMENTS

| | | | |
|---|---|---|---|
| 215745 | 3/1987 | European Pat. Off. | 26/20 |
| 312509 | 4/1989 | European Pat. Off. | 26/20 |
| 232 | of 1856 | United Kingdom | 26/21 |
| 12429 | of 1896 | United Kingdom | 26/21 |

*Primary Examiner*—Amy Vanatta
*Attorney, Agent, or Firm*—Sughrue, Mion, Zinn, Macpeak & Seas, PLLC

[57] ABSTRACT

A machine for finishing fabrics in strand from including a container and at least one entrainment pipe associated with an air flow for entraining a strand of fabric. The entrainment pipe has a terminal portion radiused to the bottom wall of the container and provided with a cross-section progressively increasing in the direction of entrainment of the fabric.

3 Claims, 2 Drawing Sheets

FINISHING MACHINE WITH PNEUMATIC ENTRAINMENT OF FABRIC IN STRAND FORM

BACKGROUND OF THE INVENTION

The present invention relates to a machine for finishing fabrics in strand form.

More specifically, the invention refers to machines of the type known, for example, from U.S. Pat. Nos. 3,780,544 and 3,921,420 in the name of Gaston County Dyeing Machine Co., which show machines for treatment of fabrics provided with a container having a bottom wall on which the fabric to be treated collects on a series of movable laps. The fabric in strand form is moved within the container by means of an entrainment pipe associated with means for producing an entrainment air flow adapted to continuously move the fabric.

Many fabrics, especially the finest and more delicate ones, show a marked tendency to the formation of signes or marks during finishing treatments carried out on the fabric in strand form. These defects seem to be essentially due to the fact that the bends which form when the fabric is collected in a strand remain in certain position for an extended time during the treatment, thereby exposing the fabric on the top of the bends more than other parts of the fabric to abrasions, compressions, rubbings, etc.

SUMMARY OF THE INVENTION

The present invention has the object to provide a finishing machine of an improved type which overcomes or at least reduces these drawbacks.

In accordance with the present invention, this object is achieved by a machine comprising a container having a bottom wall on which the fabric to be treated collects in a series of movable laps and at least one fabric entrainment pipe associated with means for producing an entrainment air flow and adapted to continuously move the fabric towards the bottom wall of the container, wherein the entrainment pipe has a terminal portion having a flat side tangentially contacting the bottom wall of the container and provided with a cross-sectional area progressively increasing in the direction of entrainment of the fabric.

The innovative principle on which the present invention is based, consists essentially in forming the pneumatic entrainment pipe with a terminal portion radiused or flattened against the bottom wall of the container and provided with a transversal section progressively increasing in the direction of entrainment of the fabric. The terminal tapered portion of the entrainment pipe provides a reduced air pressure in the terminal part of the pipe, said reduced air pressure tending to open and to move the strand of fabric, which permits a change is the position of the bends at the exit of the entrainment pipe. The radius or flat contact between the terminal portion of the entrainment pipe and the bottom wall of the container enables the laps of fabric coming out from the entrainment pipe to collect in an orderly way without subjecting the fabric to sever mechanical actions (strikes, etc.) against parts of the machine.

BRIEF DESCRIPTION OF THE DRAWINGS

Further characteristics and advantages of the present invention will become clear in the course of the detailed description which follows, given purely by way of non-limiting example, with reference to the annexed drawings, wherein.

DETAILED DESCRIPTION OF THE INVENTION

Figure 1:
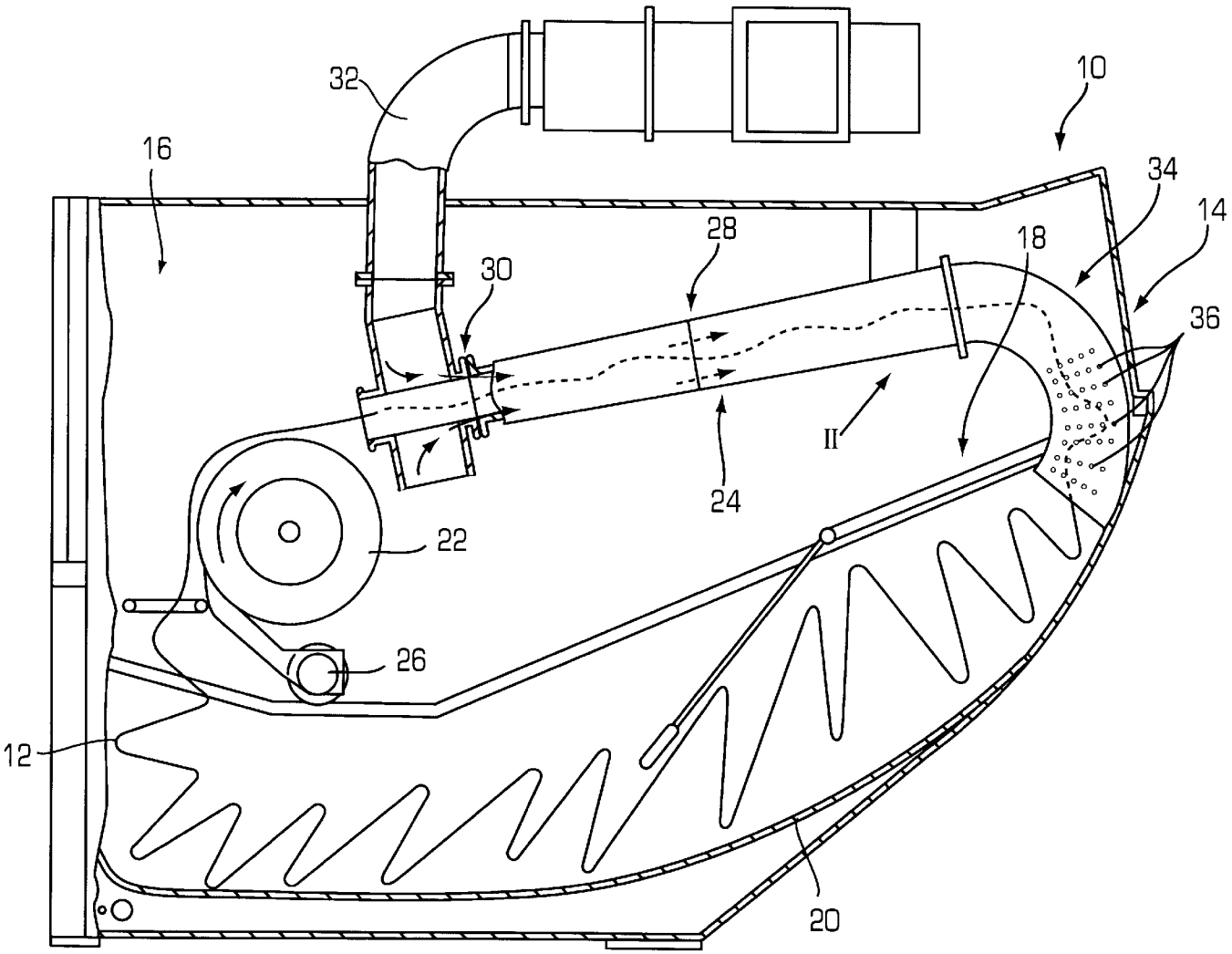
FIG. 1 is a schematic lateral view of a machine according to the invention.
Figure 2:
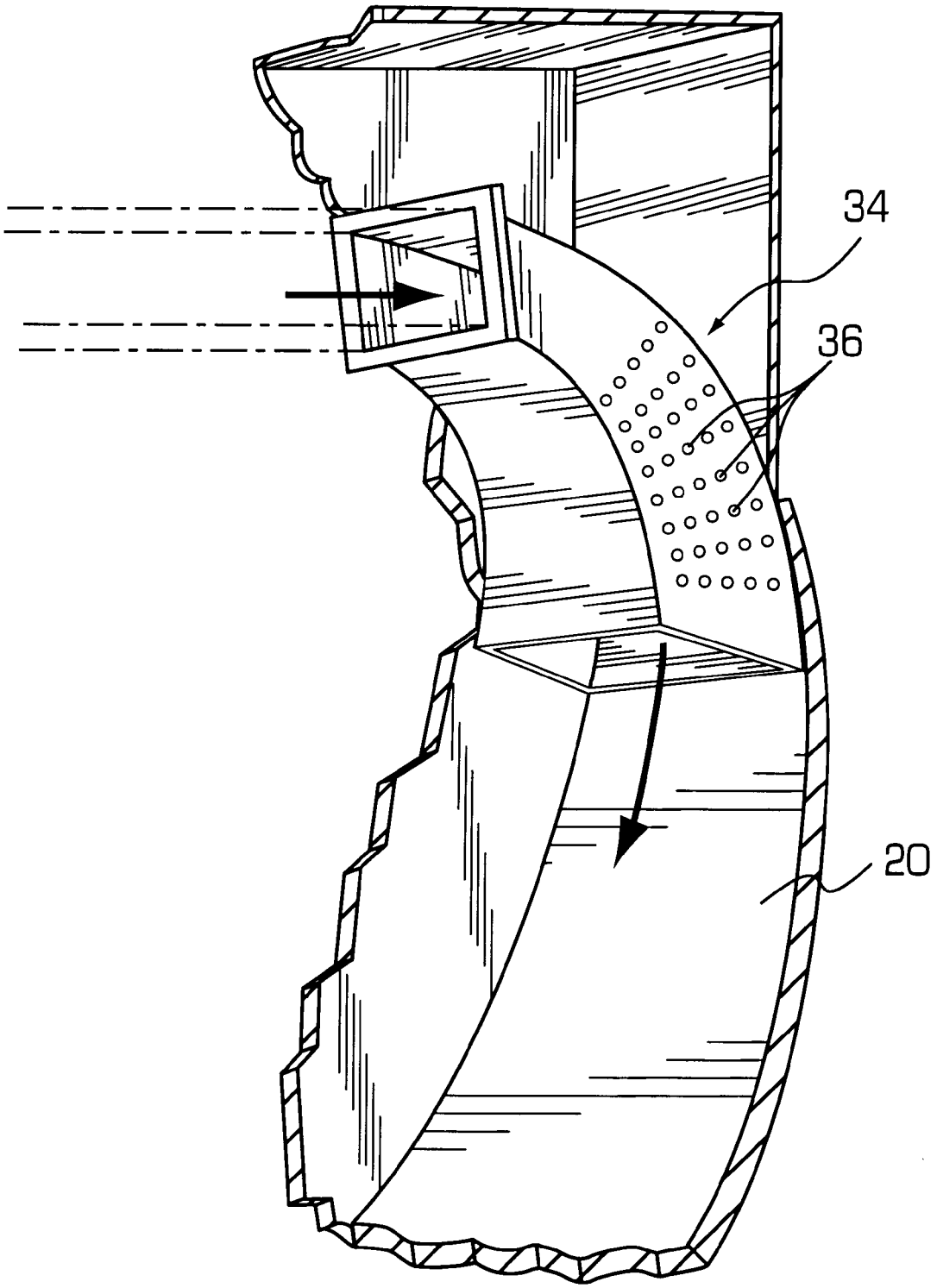
FIG. 2 is a schematic perspective view of the part indicated by arrow II in FIG. 1.

With reference to the drawings, 10 indicates a machine intended to carry out finishing treatments on one or more pieces of fabric 12 in strand form. The machine comprises a closed container 14 having a front section 16 and a rear section 18. The container 14 has a bottom wall 20 which has an arcuate shape in correspondence with the rear section 18.

In the front section 16 of the container 14 there is placed a motor-driven cylinder 22 which raises the strand of fabric 12 from the bottom of the container and supplies the strand to a pneumatic entrainment pipe 24. The raising cylinder 22 can be associated with a blower 26 which produces a laminar air flow tangent to the surface of the cylinder 22, for the purpose of moving the strand and change the position of the bends.

The machine 10 is generally arranged for operating at the same time with two or more strands of fabric arranged parallel to each other in a direction orthogonal to the plane of representation of FIG. 1. Whereas the raising cylinder 22 can be the same for all the strands of fabric, each strand 12 is associated with an individual entrainment pipe 24. In the following description the structure of only one of said entrainment pipes will be described in detail, it being intended that the other pipes are identical and disposed parallel to the first.

The entrainment pipe 24 has a central straight portion 28 formed by a metallic tube with a circular cross-sectional area slightly increasing in the direction of entrainment of the fabric. A first end of the central portion 28 is connected to a strand feeding section 30 wherein an entrainment air flow is conveyed by means of a series of distribution pipes 32, the air flow coming from a blower (not shown) placed outside the machine. A second end of the central portion 28 is joined to an elbow terminal portion 34 which is radiused or flattened on a side disposed in tangential contact with the arcuate bottom wall 20 of the container 14. The terminal portion 34 has a cross-section which progressively increases in the direction of movement of the strand of fabric. In this way, the air flow which entrains the strand 12 expands rapidly in the terminal portion 34, causing an opening of the strand with a consequent variation of the position of the bends. In order to promote this opening movement, a plurality of perforation 36 are provided on the lateral walls of the terminal portion 34 for the purpose of partially discharging air to the outside, which increases the reduced pressure effect within the terminal portion 34. Outside the terminal portion 34, the strand of fabric collects in a series of laps on the bottom wall 20. The radiused portion 34 allows the strand to smoothly contact the arcuate wall 20 and avoids strikes or severe mechanical actions against the walls of the machine.

For simplicity of construction, the terminal portion 34 may have a cross-section with a quadrangular shape, with external and internal arcuate walls constituted by sectors of sheet metal welded to each other.

I claim:

1. A machine for finishing of fabrics in strand form, comprising:

a container having a bottom wall on which the fabric to be treated collects in a series of movable laps, and at least one fabric entrainment pipe associated with means for producing an entrainment air flow and adapted to continuously move the fabric towards the bottom wall of the container, wherein the entrainment pipe has a terminal portion having a flat side tangentially contacting the bottom wall of the container and provided with a cross-sectional area progressively increasing in the direction of entrainment of the fabric.

2. A machine according to claim 1, wherein said terminal portion of the entrainment pipe is provided with a plurality of perforations adapted to produce a partial expulsion of the air flow.

3. A machine according to claim 1, wherein the entrainment pipe has a straight central portion having a cross-sectional area progressively increasing toward said terminal portion.

* * * * *